US006454594B2

(12) United States Patent
Sawayanagi

(10) Patent No.: US 6,454,594 B2
(45) Date of Patent: Sep. 24, 2002

(54) TERMINAL STRUCTURE OF FLAT CIRCUIT BODY

(75) Inventor: Masahiro Sawayanagi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/769,286

(22) Filed: Jan. 26, 2001

(30) Foreign Application Priority Data

Jan. 28, 2000 (JP) ..... 2000-020516

(51) Int. Cl.[7] ..... H01R 13/58
(52) U.S. Cl. ..... 439/467; 439/470; 439/499
(58) Field of Search ..... 439/465–467, 439/470, 495, 492, 499

(56) References Cited

U.S. PATENT DOCUMENTS 4,225,205 A * 9/1980 Sinclair et al. ..... 439/467
4,596,432 A * 6/1986 Tighe, Jr. ..... 439/467
5,277,617 A * 1/1994 Shasteen ..... 439/465
5,569,050 A * 10/1996 Lloyd ..... 439/465
5,813,877 A * 9/1998 Nakamura ..... 439/495
6,030,252 A * 2/2000 Oda et al. ..... 439/470

FOREIGN PATENT DOCUMENTS

JP 6-208873 7/1994

* cited by examiner

*Primary Examiner*—Hien Vu
(74) *Attorney, Agent, or Firm*—Finnegan, Henderson, Farabow, Garrett & Dunner, L.L.P.

(57) ABSTRACT

A terminal structure of a flat circuit body includes: a flat circuit body having a plurality of conductors and insulating films for sandwiching the plural conductors; a plurality of connection terminals connected and fixed to the plural conductors respectively; a connector housing having a plurality of terminal housing chambers for housing the plural connection terminals; and a housing cover fixed to the connector housing, the housing cover having partition walls for separating terminal vicinity portions of the conductors in the flat circuit body and connection portions of the connection terminals from other adjacent conductors and other connection terminals in next side thereof. In the construction, the housing cover is attached so as to cover the terminal vicinity portions of the flat circuit body and the connector housing integrally.

6 Claims, 4 Drawing Sheets

RRIOR ART

TERMINAL STRUCTURE OF FLAT CIRCUIT BODY

BACKGROUND OF THE INVENTION

1. Field of the Invention

The present invention relates to a terminal structure of a flat circuit body such as a flexible flat cable (FFC) and a flexible print circuit (FPC).

2. Description of the Related Art

In general, in the case where circuits are electrically connected with one another by using a flat circuit body. a connector is attached to a terminal of the flat circuit body, and this connector is connected to a mating connector. As such a terminal structure of a flat circuit body, a technique shown in FIG. 1, which is disclosed in Japanese Patent Application Laid-Open No. 6-208873, is known.

As shown in FIG. 1, FPC 1 as a flat circuit body is such that a plurality of conductors 2 are sandwiched by insulating films, and portions of the conductors 2 in a vicinity of a terminal portion of the FPC 1 are exposed, and contacts (connection fittings) 3 are caulked to be coupled to conductor terminals 2*a*. The contacts 3 are housed and arranged and supported in contact arrangement spaces 4*a* of a connector housing 4.

However, in the above-mentioned terminal structure of the flat circuit body, since connection portions (piercing connection portions) between the contacts 3 housed in the connector housing 4 and the conductor terminals 2*a* are exposed, short circuit might occur due to contact such as adhesion of foreign matters. Moreover, in the case where condensation occurs on or water drops adheres to the connection portions between the contacts 3 and the conductor terminal 2*a*, there arises a problem that a leak current is generated.

In addition, in the above terminal structure, fixing between the FPC 1 and the connector housing 4 is obtained by fixing between the contacts 3 and the connector housing 4. For this reason, there arises a problem that a coupling strength between the contacts 3 and the FPC 1 is weak.

Since a tension from the FPC 1 is transmitted directly to the contacts 3, the contacts 3 are likely to move in the connector housing 4, and thus contact resistance might increase.

SUMMARY OF THE INVENTION

Therefore, the present invention is devised taking the above circumstances into consideration, and it is an object of the present invention to provide a terminal structure of a flat circuit body which is capable of preventing short circuit between conductors due to moisture, foreign matters or the like and obstructing movement of connection terminals so as to prevent a fluctuation In contact resistance.

A first aspect of the present invention provides a terminal structure of a flat circuit body, comprising: a flat circuit body includes; a plurality of conductors arranged with predetermined intervals; and insulating films for sandwiching the plural conductors so as to fix the conductors; a plurality of connection terminals connected and fixed to the plural conductors respectively; a connector housing having a plurality of terminal housing chambers for housing the plural connection terminals; and a housing cover fixed to the connector housing, the housing cover having partition walls for separating terminal vicinity portions of the conductors in the flat circuit body and connection portions of the connection terminals from other adjacent conductors and other connection terminals in next side thereof, wherein the housing cover is attached so as to cover the terminal vicinity portions of the flat circuit body and the connector housing integrally.

Therefore, in the invention having such a structure, the terminal portion of the flat circuit body is covered by the housing cover, and the connection portions between the conductors and the connection terminals are separated from one another by the partition walls. As a result, adhesion of foreign matters or water drops is prevented so that the conductors or the connection terminals can be prevented from short-circuiting. The partition walls gain a creeping distance between the conductors even if electrically conductive fluid such as water drops adheres. For this reason, generation of a leak current can be prevented.

A second aspect of the present invention provides the terminal structure of the flat circuit body according to the first aspect, wherein: the housing cover has a lower cover, an upper cover and hinge portion for pivoting the upper cover with respect to the lower cover; and the partition walls are provided in such a manner that the partition wall formed on the lower cover and the other partition wall formed on the upper cover are stuck together.

Therefore, in the invention according to the second aspect, since the housing cover has the lower cover and the upper cover via the hinge portions, the connector housing and the terminal portion of the flat circuit body are sandwiched to be surrounded by the lower cover and the upper cover. As a result, the terminal structure can be formed easily.

A third aspect of the present invention provides the terminal structure of the flat circuit body according to the second aspect, wherein rear end portion of the housing cover sandwiches the terminal vicinity portions of the flat circuit body.

Therefore, in the invention according to the third aspect, the rear end portions of the housing cover sandwich the terminal vicinity of the flat circuit body. Even if a tension or a stress from the outside is transmitted via the flat circuit body, since the terminal vicinity of the flat circuit body is sandwiched and supported by the housing cover, the tension or stress is not transmitted to the connection terminals in the connector housing. As a result displacement or movement of the connection terminals can be prevented. For this reason, increase or fluctuation in contact resistance at the connection terminals can be prevented.

A fourth aspect of the present invention provides the terminal structure of the flat circuit body according to the third aspect, wherein: a stepped portion is formed on one of a rear end portion of the lower cover and a rear end portion of the upper cover; and a pier portion which is substantially stuck with the stepped portion in offset state is formed on the other of the rear end portion of the lower cover and the rear end portion of the upper cover.

Therefore, in the invention according to the fourth aspect, the terminal vicinity of the flat circuit body can be held easily only by sandwiching the terminal vicinity of the flat circuit body by means of the lower cover and the upper cover. Moreover, the terminal portion of the flat circuit body is sandwiched by the stepped portion and the pier portion so as to be sandwiched on surfaces of at least two directions. For this reason, displacement of the conductors to an extended direction can be prevented securely.

BRIEF DESCRIPTION OF THE ACCOMPANYING DRAWINGS

The above and further objects and novel features of the present invention will more fully appear from the following detailed description when the same is read in conjunction with the accompany drawings, in which:

FIG. 1 is an exploded perspective view showing a prior terminal structure of a flat circuit body;

FIG. 2 an exploded perspective view showing a terminal structure of a flat circuit body according to an embodiment of the present invention;

DESCRIPTION OF THE PREFERRED EMBODIMENTS

Figure 1:
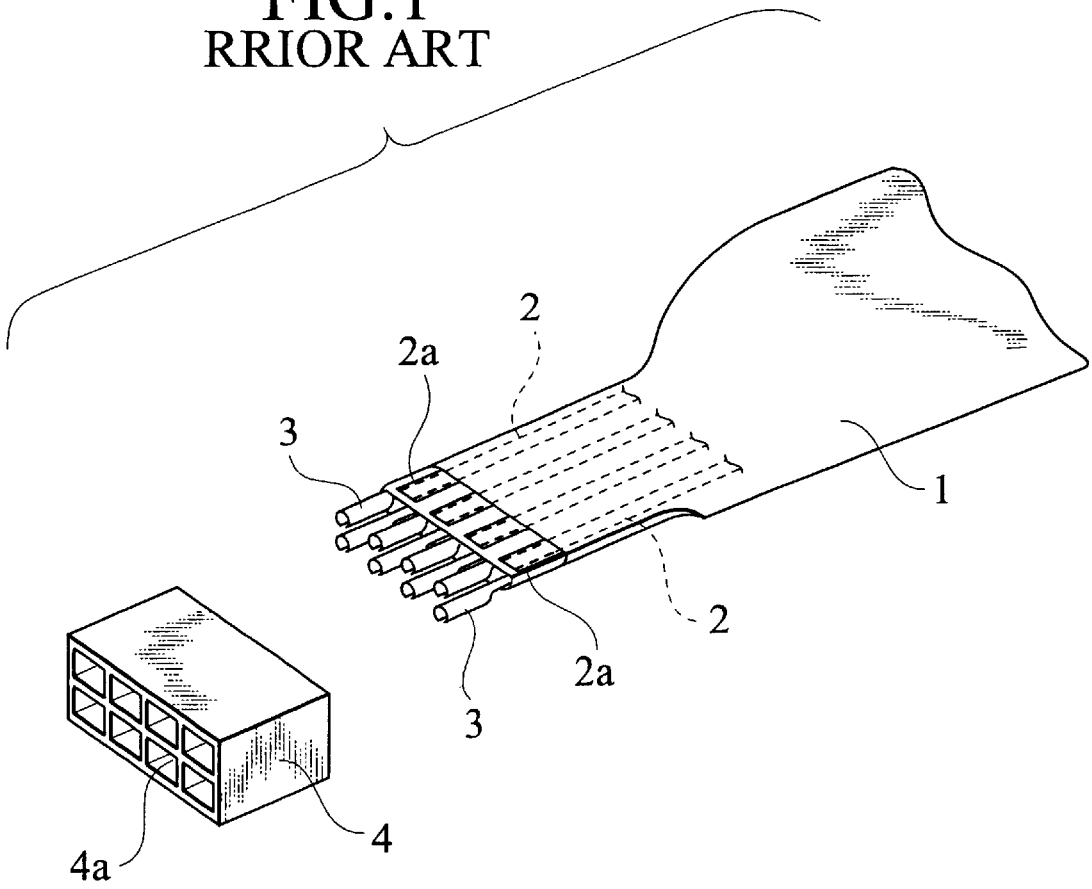

There will be detailed below a terminal structure of a flat circuit body according to the present invention based on an embodiment shown in the drawings, Here, in the present embodiment, a flexible flat cable (hereinafter, FFC) is used as a flat circuit body.

Figure 2:
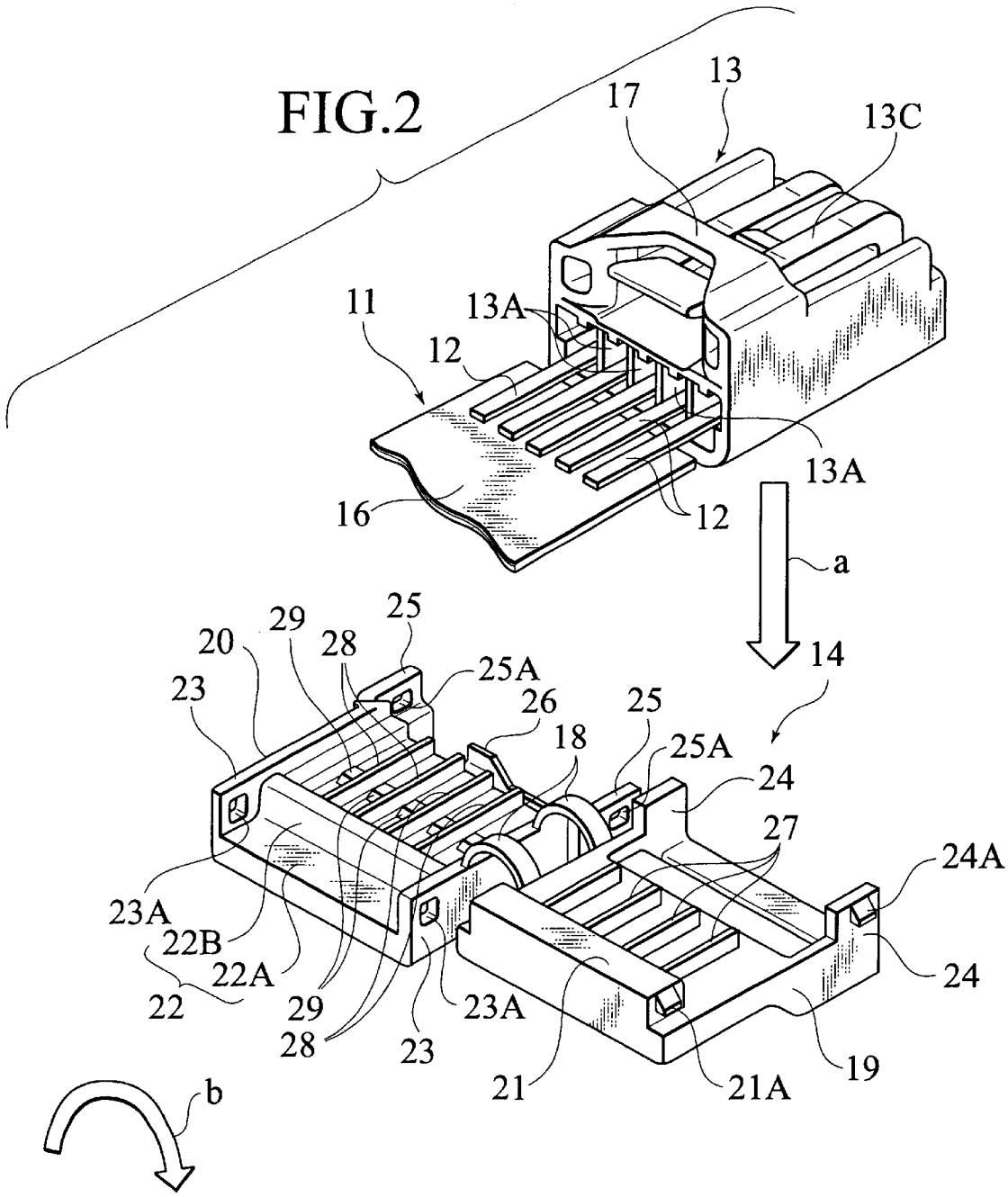
Figure 3:
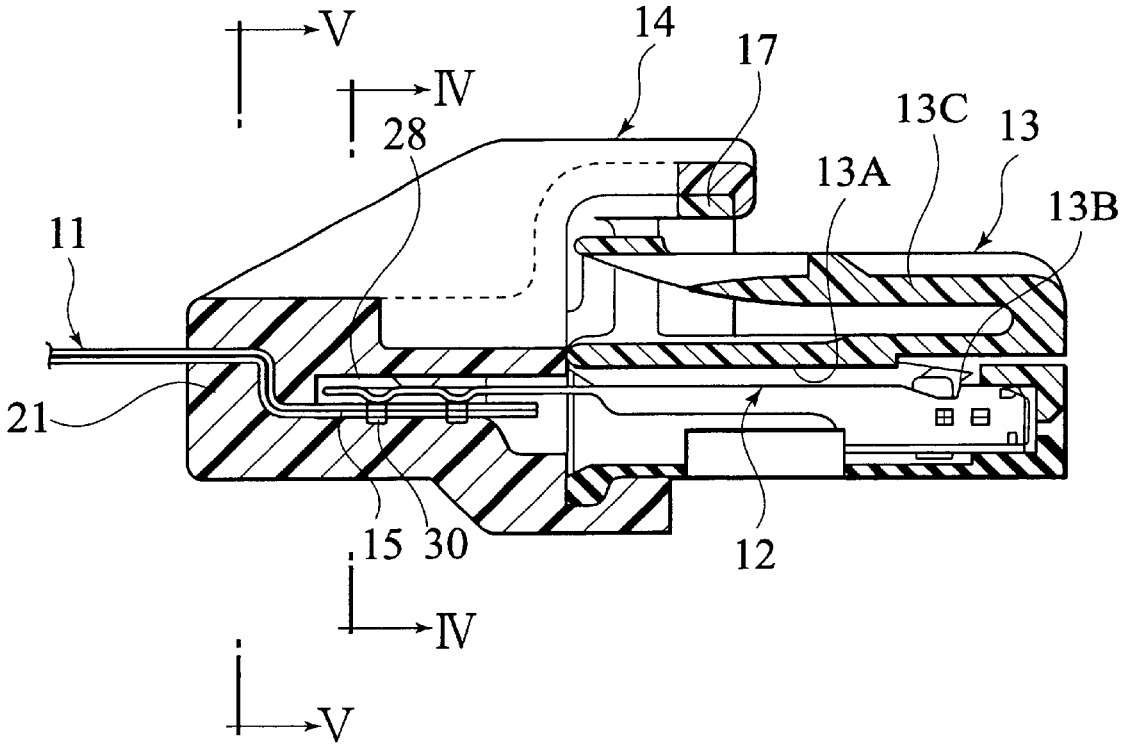
FIG. 3 is a vertical sectional view showing a state that the terminal structure of the embodiment is cut in a front-rear direction.

As shown in FIGS. 2 and 3, the terminal structure of the flat circuit body according to the present embodiment is substantially composed of FFC 11, a plurality of connection terminals 12 connected to the FFC 11, a connector housing 13 for housing and fixing the connection terminals 12, and a housing cover 14.

The FFC 11 is constituted so that a plurality of long conductors 15 which are rolled and made of copper foil or the like are sandwiched between a pair of base films (see FIG. 5) 16, 16 by using adhesive in parallel with predetermined intervals. At a terminal of the FFC 11, as shown in FIGS. 2 and 3, the conductors 15 are piercing-connected with rear end portions of the connection terminals 12 by means of connection portions 30. The connection terminals 12 whose rear end portions are connected to the terminals of the conductors 15 are housed in cavity portions 13A formed in the connector housing 13 so as to be engaged with and fixed to terminal engagement portions 13B provided on upper portions of the cavity portions 13A.

As mentioned above, the connector housing 13 is provided with a plurality of cavity portions 13A as terminal housing chambers and with a cover engagement portion 17, which engages with the housing cover 14, at an upper portion. This cover engagement portion 17 hangs across the upper portion of the rear end side of the connector housing 13 in a widthwise direction. Moreover, an engagement spring piece 13C which is extended to the rear end side integrally with the upper portion of the front end side of the connector housing 13 in a state that it lifts from the upper surface. This engagement spring piece 13C is used for coupling with a mating connector, not shown.

Next, there will be explained below a structure of the housing cover 14. As shown in FIG. 2, the housing cover 14 has a lower cover 19 and an upper cover 20 between which hinge portions 18, 18 intervene. A pier portion 21 is protruded from a rear end upper portion of the lower cover 19 across its widthwise direction. Correspondingly, a stepped portion 22 for housing the pier portion 21 is formed on a rear end lower surface of the upper cover 20 (the hinge portions 18 are bent so that the lower surface is formed). This stepped portion 22 is composed of an upper wall surface portion 22A which is opposed to an upper surface of the pier potion 21 via a slight distance when the hinge portions 18, 18 are bent and the lower cover 19 is mounted to the upper cover 20, and a side surface portion 22B which is opposed to a front surface of the pier portion 21 via a slight distance. Moreover, engagement protrusions 21A are formed respectively on both side surfaces of the pier portion 21. Correspondingly, side walls 23, 23 are formed on both rear end side surfaces of the upper cover 20, and engagement holes 23A which engage with the engagement protrusions 21A of the pier portion 21 are formed respectively on the side walls 23.

In addition, side walls 24, 24 are arranged in a standing manner respectively on both front end side portions of the lower cover 19, and engagement protrusions 24A are formed respectively on outer side surface upper portions of the side walls 24. Correspondingly, side walls 25, 25 are formed on both front end sides of the upper cover 20. Engagement holes 25A which engage with the engagement protrusions 24A are formed respectively on the side walls 25. An engagement piece 26, which is engaged with the cover engagement portion 17 when attached to the connector housing 13, is formed on a front end portion of the upper cover 20.

Further, a plurality of partition walls 27 are arranged in a standing manner on the lower cover 19 in parallel along the front-rear direction. Meanwhile, partition walls 28 corresponding to the partition walls 27 formed on the lower cover 19 are formed on the upper cover 20. Moreover, conductor supporting protrusions 29 with similar height to that of the partition walls 28 are formed in grooves which are formed by arranging the partition walls 28 on the upper cover 20 in a standing manner. Here, a number of the partition walls 27 and 28 is set so as to be the same as a number of wall portions composing the cavity portions 13A of the connector housing 13. When the lower cover 19 is attached to the upper cover 20, the partition walls 27 the partition walls 28 are stuck together correspondingly so that connection spaces whose number is the same as a number of the cavity portions 13A of the connector housing 13 are formed.

Figure 4:
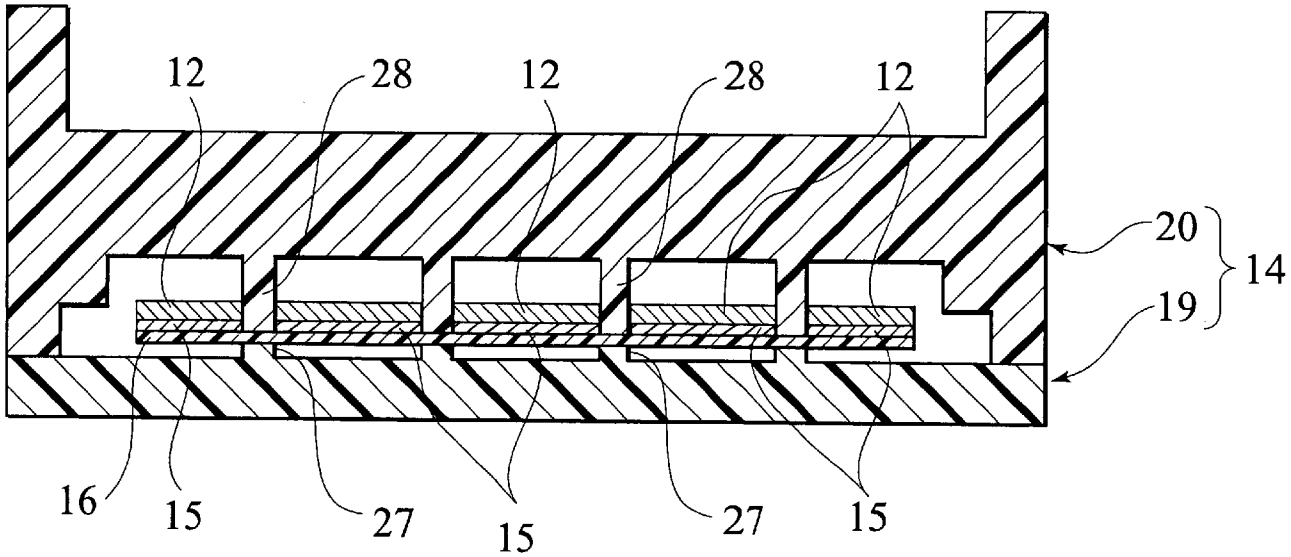
FIG. 4 is a sectional view taken along line IV—IV of FIG. 3.
Figure 5:
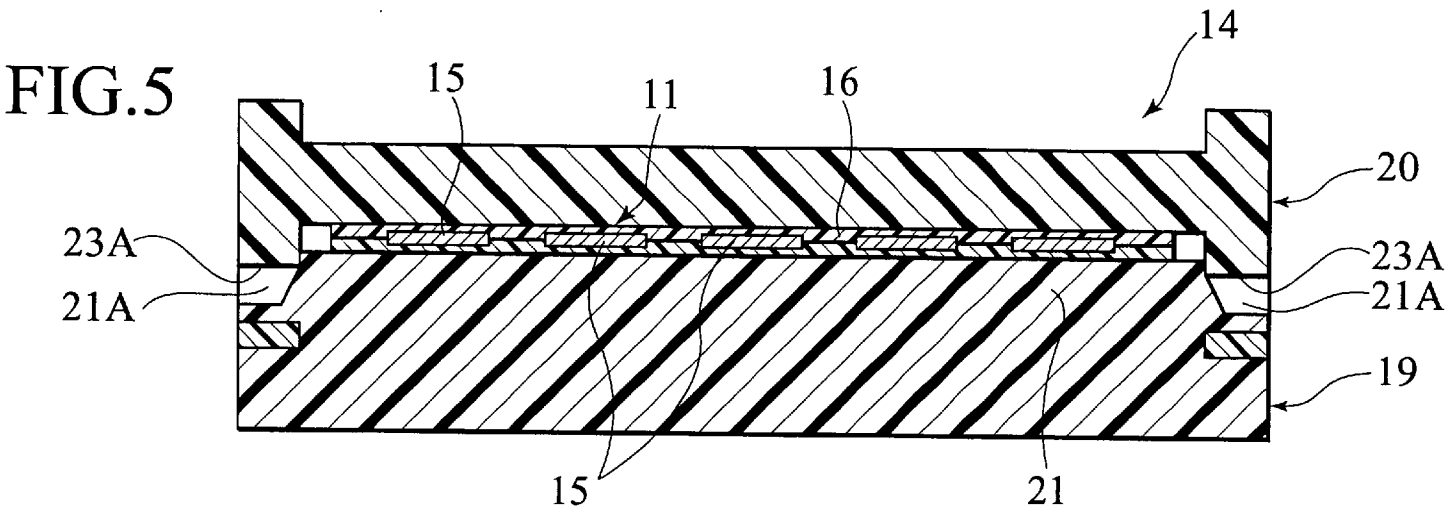
FIG. 5 is a sectional view taken along line V—V of FIG. 3.

As shown in FIGS. 3 and 4. the rear end portions of the connection terminals 12 piercing-connected to the conductors are housed in the spaces formed in the housing cover 14. Moreover, as shown in FIG. 2. the vicinity of the end portion of the FFC 11 is also sandwiched by the housing cover 14. More concretely, as shown in FIG. 2, the terminal vicinity of the FFC 11 is sandwiched by the pier portion 21 of the lower cover 19 and the stepped portion 22 of the upper cover 20 as shown in FIG. 5. For this reason, the pier portion 21 and the stepped portion 22 sandwich the FFC 11 so as to serve as a strain relief for preventing slipping and movement of the PFC 11.

Next, there will be explained below a procedure for forming the terminal structure of the flat circuit body according to the present embodiment. At first as represented by a thick arrow a in FIG. 2, the connector housing 13, to which the FFC 11 and the connection terminals 12 are attached, is placed on the lower cover 19. Thereafter, the upper cover 20 is pivoted on the hinge portions 18. 18 as shown by a thick arrow b in the drawing and the upper cover 20 is matched with the lower cover 19 so that the connector housing 13 is surrounded by the housing cover 14. At this time, the engagement piece 26 formed on the front end portion of the upper cover 20 is engaged with the cover engagement portion 17 of the connector housing 13 so as to prevent the connector housing 13 from coming out of the housing cover 14. Moreover, the lower cover 19 and the upper cover 20 are mounted and fixed to each other in such a manner that the engagement protrusions 21A and the engagement holes 23A engage with one another and the engagement protrusions 24A and the engagement holes 25A engage with one another.

As mentioned above, In the terminal structure of the flat circuit body according to the present embodiment, the rear end portions of the connection terminals 12 exposed at the terminal of the FFC 11 are independently separated from one another by the partition walls 27 and 28 of the housing cover 14. For this reason, foreign matters or water drops can be prevented from adhering to between the rear end portions of the connection terminals 12 or between the conductors 15, and occurrence of short circuit can be prevented. Moreover, if fluid such as water drops comes thereinto, the partition walls 27 and 28 are formed so that a creeping distance can be gained. As a result, a leak current can be prevented from being generated.

In addition, in the above-mentioned present embodiment, if an external force is transmitted to the housing cover 14 via the FFC 11, since the pier portion 21 of the lower cover 19 and the stepped portion 22 of the upper cover 20 sandwich and hold the FFC 11, the external force is not transmitted to the inside. The connection terminals 12 are prevented from being displaced and the connection points are not moved. As a result, increase or fluctuation in contact resistance can be prevented.

The embodiment was explained, but the present invention is not limited to this, and various modifications can be made within a scope of the gist of the structure. For example, in the above-mentioned embodiment, the FFC 11 was used as the flat circuit body, but FPC may be used.

The entire contents of Japanese Patent Application P2000-20516 (filed on Jan. 28, 2000) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A terminal structure of a flat circuit body, comprising:

a flat circuit body including:

a plurality of conductors arranged with predetermined intervals; and insulating films for sandwiching the plurality of conductors so as to fix the conductors;

a plurality of connection terminals connected and fixed to the plurality of conductors respectively;

a connector housing having a cover engagement portion at an upper portion thereof, a plurality of terminal housing chambers for housing the plurality of connection terminals; and a housing cover fixed to the connector housing, the housing cover having partition walls for separating terminal vicinity portions of the conductors in the flat circuit body and connection portions of the connection terminals from other adjacent conductors and other connection terminals on either side of the terminal vicinity portion and connection portion, wherein the housing cover with engagement piece at a front end thereof is attached to said connector housing so as to cover the terminal vicinity portions of the flat circuit body and the connector housing integrally; and wherein the engagement piece is engaged with the cover engagement portion so as to prevent the connector housing from coming out of the housing cover when the housing cover is attached to said connector housing.

2. A terminal structure of a flat circuit body according to claim 1, wherein the housing cover has a lower cover, an upper cover and hinge portion for pivoting the upper cover with respect to the lower cover; and wherein the partition walls are provided in such a manner that the partition wall formed on the lower cover and the other partition wall formed on the upper cover are engaged with one another.

3. A terminal structure of a flat circuit body according to claim 2, wherein rear end portion of the housing cover sandwiches the terminal vicinity portions of the flat circuit body.

4. A terminal structure of a flat circuit body according to claim 2, wherein a stepped portion is formed on one of a rear end portion of the lower cover and a rear end portion of the upper cover; and wherein a pier portion which is substantially engaged with the stepped portion in offset state is formed on the other of the rear end portion of the lower cover and the rear end portion of the upper cover.

5. A terminal structure of a flat circuit body according to claim 1, wherein rear end portion of the housing cover sandwiches the terminal vicinity portions of the flat circuit body.

6. A terminal structure of a flat circuit body according to claim 3, wherein a steeped portion is formed on one of a rear end portion of the lower cover and a rear end portion of the upper cover; and wherein a pier portion which is substantially engaged with the stepped portion in offset state is formed on the other of the rear end portion of the lower cover and the rear end portion of the upper cover.

* * * * *